US005274901A

United States Patent [19]

Sanders

[11] Patent Number: 5,274,901

[45] Date of Patent: Jan. 4, 1994

[54] METHOD OF APPLYING A GOLF BAG RAIN CAPE

[76] Inventor: Ralph S. Sanders, 4315 W. Howard St., Skokie, Ill. 60076

[21] Appl. No.: 726,766

[22] Filed: Jul. 8, 1991

[51] Int. Cl.[5] ..... A63B 55/00

[52] U.S. Cl. ..... 29/525.1; 29/433; 150/159

[58] Field of Search ..... 29/525.1, 433; 150/159, 150/160; 224/274

[56] References Cited

U.S. PATENT DOCUMENTS

| | | | |
|---|---|---|---|
| 2,747,637 | 5/1956 | Brown | 150/159 |
| 3,059,681 | 10/1962 | Lorbeski | 150/159 |
| 4,453,632 | 5/1984 | Clower | 150/160 X |
| 5,024,259 | 6/1991 | Treadway | 150/159 |
| 5,099,897 | 3/1992 | Curtin | 150/159 |
| 5,131,442 | 7/1992 | Bevier | 150/159 |

*Primary Examiner*—Timothy V. Eley
*Attorney, Agent, or Firm*—Walter L. Schlegel, Jr.

[57] ABSTRACT

A rain cape for a golf bag comprising means removably tying the cape approximately midway between the top and bottom portions thereof, the top portion being folded over to define a cover for the cape and having a hook engagable with the means or with a handle on a cart carrying the bag.

2 Claims, 2 Drawing Sheets

METHOD OF APPLYING A GOLF BAG RAIN CAPE

This invention relates to a golf bag rain cape and more particularly to a waterproof rain cape providing easy access to the clubs contained in the bag protected by the cape.

Rain and dampness are harmful to golf clubs and golf bags and a need for a cape which will simultaneously protect both clubs and bag against rain and dampness, without interfering with the use of the bag and clubs is needed.

It is the primary end of the present invention, therefore, to provide an improved cape which will furnish this needed protection. This new and improved cape envelops and effectively waterproofs the clubs and bag during normal use and thereby protects them from rain and dampness. In addition, the cape is transparent, permitting the player a ready visual selection of the clubs. Since the cape is made from collapsible lightweight material, it adds no appreciable weight or bulk to the golf bag and can be folded and easily stored in a pocket of the bag when not in use.

Access to the clubs is provided by a transparent cover at the top of the cape which overlaps the clubs and is provided with a hook which is attached to a handle of the golf card upon which the bag is seated.

The foregoing and other objects of the invention will become apparent from a consideration of the following specification and the accompanying drawings, wherein.

Figure 1:
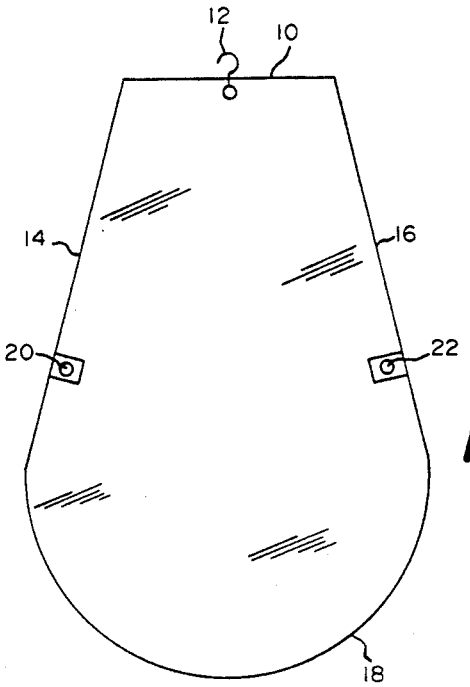
FIG. 1 is a plan view of the novel rain cape before folding to finished form.
Figure 2:
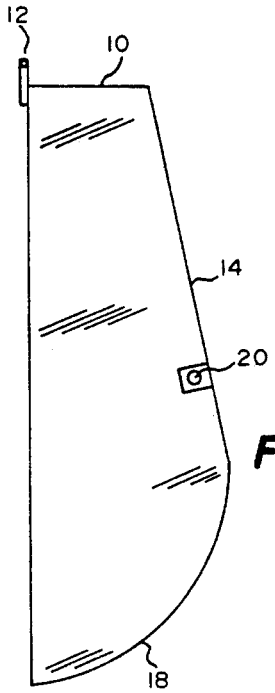
FIG. 2 is an edge elevational view taken from the right as seen in FIG. 1 showing the cape in folded form.
Figure 3:
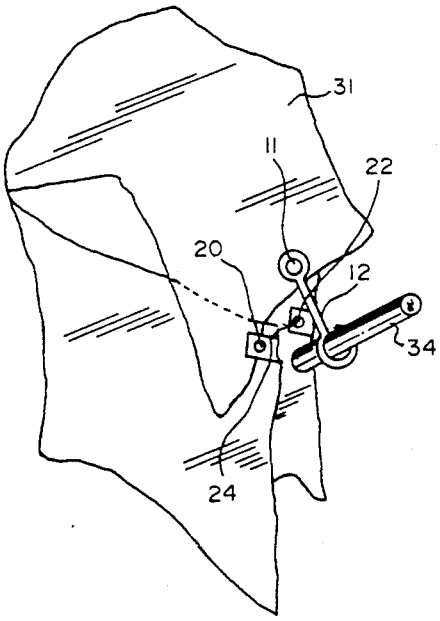
FIG. 3 is an isometric view showing the hook attached to the handle.

As shown in FIG. 1, the novel rain cape preferably has a flat top 10 connected to a hook 12. Flat sides 14 and 16 slope in opposite directions from the hook 12 and merge with a round bottom portion 18. The flat sides have eyelets 20 and 22 adopted for reception of a small cord 24 tying the flat sides, 14 and 16, together, as best seen in FIG. 3.

Figure 5:
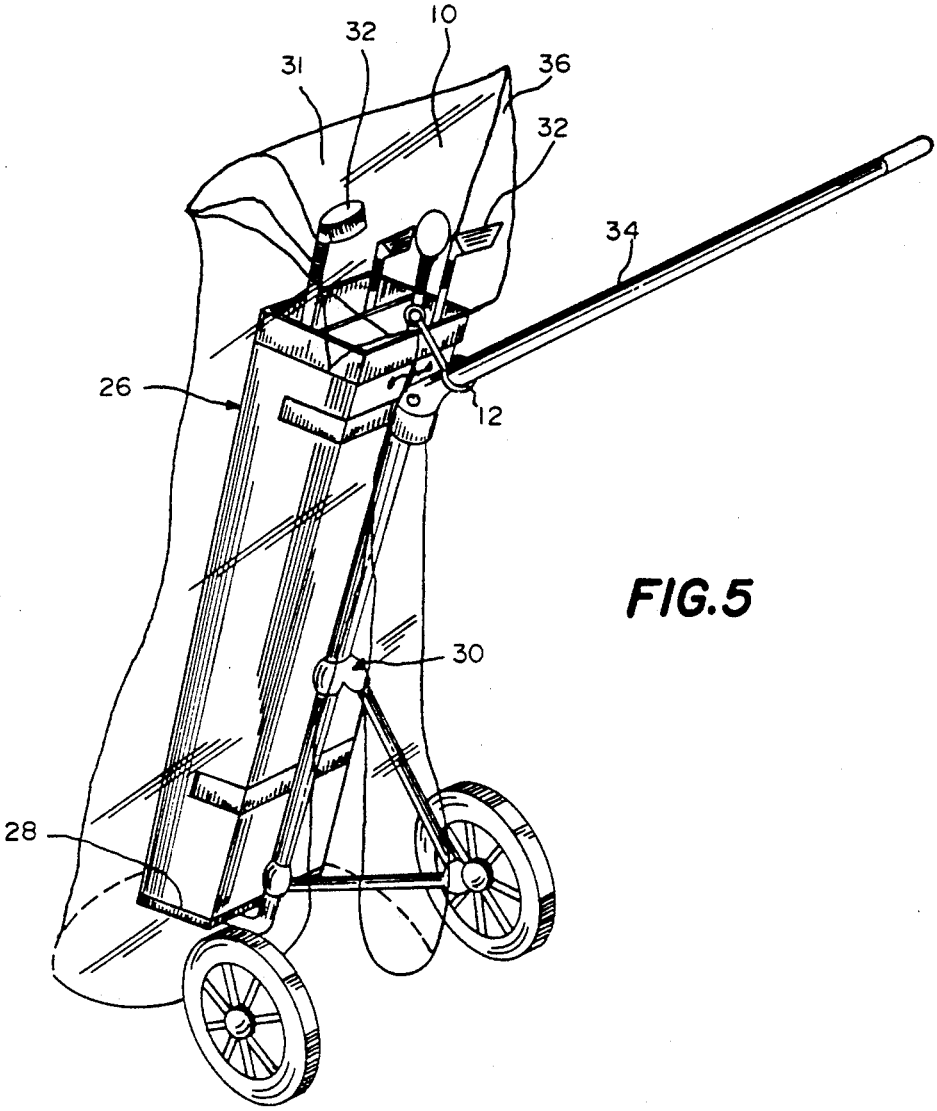
FIG. 5 is an isometric view showing the rain cape applied to a golf bag on a conventional cart.
Figure 6:
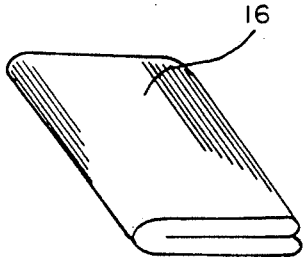
FIG. 6 shows the rain cape in folded form ready for installation in a pocket (not shown) of the bag shown in FIG. 5.

The novel rain cape is shown in FIG. 5 as applied to a conventional bag 26 mounted at 28 on a conventional cart 30. The flat portion 10 is folded to afford a transparent cover 31 for the bag 26 and the clubs 32 therein. The cover 31 is held closed by the hook 12 which is pivotally mounted on the flat portion at 11 and which is looped over the handle 34 of the cart 30. Preferably the hook is formed of flexible metal such as mild steel which can be manually bent to wrap around the handle 34 once the hook 12 has been installed as best seen in FIGS. 3 and 5.

Figure 4:
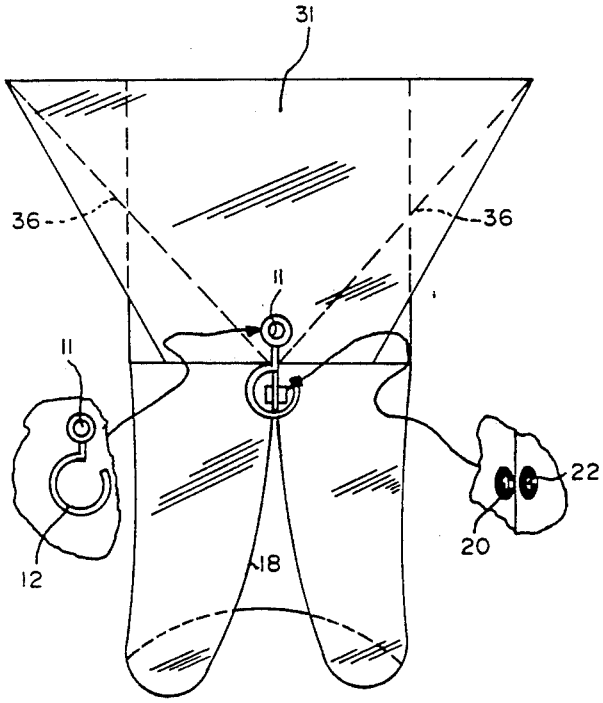
FIG. 4 is a view taken from right as seen in FIG. 3 showing the hook ready for attachment to the handle.

The cover 31 is open at both sides thereof as at 36 FIGS. 4 and 5 so the golfer can select the club he wants and replace it without disconnecting the hook from the handle 34. If desired the hook 12 can be attached to the cord 24 instead of the handle 34.

What is claimed is:

1. A method of applying a rain cape to a golf bag said method comprising tying a cord to eyelets formed in adjacent sides of the cape, then dropping the cape over the bag until the cord is stopped by engagement of the cord with a handle of a cart for steering the cart which carries the bag, then folding the upper end of the cape to afford a cover, and attaching a hook on said cover and on said handle on said cart.

2. A method according to claim 1 wherein the cover is transparent.

* * * * *